United States Patent [19]

Waage

[11] 4,152,964

[45] May 8, 1979

[54] KEYBOARD CONTROLLED JUST INTONATION COMPUTER

[76] Inventor: Harold M. Waage, 7T Magie Apts., Faculty Rd., Princeton, N.J. 08540

[21] Appl. No.: 842,722

[22] Filed: Oct. 17, 1977

[51] Int. Cl.[2] ..... G10H 5/00

[52] U.S. Cl. ..... 84/1.01; 84/1.03; 84/DIG. 18; 84/DIG. 22

[58] Field of Search ..... 84/1.01, 1.03, 1.04, 84/1.06, 1.07, 1.08, DIG. 22, 454, DIG. 18

[56] References Cited

U.S. PATENT DOCUMENTS

| | | | |
|---|---|---|---|
| 2,232,600 | 2/1941 | Fickenscher | 84/1.01 |
| 2,293,499 | 8/1942 | Fisher | 84/1.01 |
| 2,422,940 | 6/1947 | Waage | 84/1.01 |
| 2,525,524 | 10/1950 | Chase | 84/1.01 |
| 3,821,460 | 6/1974 | Maynard | 84/1.01 |
| 3,825,667 | 7/1974 | Schrecongost | 84/1.01 |
| 3,872,765 | 3/1975 | Amaya | 84/1.01 |
| 3,954,039 | 5/1976 | Southard | 84/1.01 |

*Primary Examiner*—Gene Z. Rubinson
*Assistant Examiner*—William L. Feeney
*Attorney, Agent, or Firm*—Richard C. Woodbridge

[57] ABSTRACT

A keyboard controlled just intonation computer for electronic organs which automatically responds to correct the larger tuning errors of equal temperament as each interval or chord is played. The logic circuit for this purpose has twelve inputs corresponding to the twelve notes of the chromatic scale. The logic circuit can be interfaced with the keyboard by utilizing keyer voltages from octavely related key switches fanning into each input of the logic circuit through a diode branch circuit. Each of the twelve master oscillators of the organ has a two input tuning means adjusted to lower the frequency of the master oscillator by one seventh of a semitone if one input is energized by an output of the logic circuit or by three tenths of a semitone if the other input is energized. The smaller pitch shift is required for the top notes of major thirds or major sixths, or for the bottom notes of minor thirds or minor sixths. The larger pitch shift is required for the top note of the minor seventh in dominant chords. This automatic just intonation system can be applied to an organ which has a conventional keyboard and is normally tuned to the fixed scale of equal temperament to provide an improved instrument of flexible intonation which yields perfectly tuned chords in both the diatonic and the septimal systems of harmony and which also allows complete freedom of modulation among the twelve tonalities. When the logic circuit is turned off the instrument remains tuned to equal temperament.

11 Claims, 11 Drawing Figures

R03
R04
R05
R06
D01
D02
D03
D04
R01
R02
R010
R07
R08
C03
M01
C01
M02
C02
R09
C05
C04
C06
FD1
FD2
DC1
DC16
DB1
DB2
DB3
DB4
DB5
DB6
DB7
DB8
DB9
RB1
RB2
RB3
RB4
RB5
RB6
RB7
RB8
RB9
RB10
RB11
RB12
RB13
RB14
RB15
RB16
RB17
RB18
RB19
RB20
RA1
RA2
RA3
RA4
RA5
RA6
RA7
RA8
RA9
RA10
RA11
DA1
DA2
DA4
DA6
DA8
DA10
DA12
DA14
DA16
DA18
DA20
DA21
DA22
DA17
DA19
DA15
DA13
DA11
DA9
DA7
DA5
DA3
P1
P2
P3
P4
P5
P6
P7
P8
P9
P10
P11
P12
P13
P14
P15
P16
P17
BC1
BC2
DL25
DL26
DL27
DL28
RL1-RL12
RL13-RL24

KEYBOARD CONTROLLED JUST INTONATION COMPUTER

BACKGROUND OF THE INVENTION

1. Field of the Invention

This invention relates to keyboard musical instruments and more particularly to a keyboard controlled just intonation computer which automatically corrects the larger tuning errors of the equal tempered scale as each interval or chord is played.

2. Description of the Prior Art

The theoretical basis for all prior art systems of just intonation for keyboard instruments is the assumption that all the harmonic resources required for most types of music can be derived from just scales of fixed pitch, one for each chosen tonality. As all prior art systems were scale determined they could not be fully automatic because scale selection requires additional mental and manual effort on the part of the player of the instrument. There were two approaches to the problem of scale selection.

One method was to have all the required notes playable by means of separate keys on a complex keyboard constructed in the form of a matrix so that harmonically related notes would lie within easily fingered rows of keys. Greater versatility with this approach could be achieved only at the expense of greater complexity of the keyboard. Typical of many such keyboard designs is the one disclosed in U.S. Pat. No. 2,232,600 to Arthur Fickensher.

The other method made it possible to simplify the keyboards or to retain the conventional keyboard by providing tonality stops which would cause the entire instrument to be retuned to any one of several just scales, one for each chosen tonality. For each modulation into a new key or for each new transposed chord, another tonality stop would have to be turned on. Typical of the tonality stop systems are U.S. Pat. No. 2,293,499 to Sidney T. Fisher and U.S. Pat. No. 2,525,524 to A. J. Chase.

The disadvantages of fixed scale systems will be evident from the following description: It is well known that the just scale C D $E_1$ F G $A_1$ $B_1$ C which is generated by the perfectly tuned chords F $A_1$ C, C $E_1$ G and G $B_1$ D, contains the imperfect minor chord D F $A_1$ in which the note D is a comma too sharp relative to the note $A_1$. On a fixed scale basis, a perfectly tuned chord $D_1$ F $A_1$ can be had only as the submediant triad in the key of F Major or as the mediant triad in the key of B Flat Major, by momentarily turning on either of these tonality stops. A further disadvantage of just intonation on a fixed scale basis is that the same mis-tuned triad D F $A_1$ which would also be contained in the dominant ninth chord G $B_1$ D F $A_1$, renders that chord even more dissonant than the same chord in equal temperament. A correctly tuned chord G $B_1$ D $F_2$ A is available only by temporarily turning on the tonality stop for the key of G Major, if this scale has an additional note $F_2$ about two commas lower than the normal note F. Therefore, the use of at least three tonality stops would be required to render in just intonation even the simplest music based upon the seven notes of the diatonic scale. In order to play music of greater harmonic complexity, in which chords are used for coloration of the melodic line as well as for definition of tonality, too much attention to tonality stops would be required and such music would be difficult, if not impossible, to play upon a multidigital keyboard. A useful description of typical present day organs may be found in a book entitled "Organ Builder's Guide" 1976, 3rd Edition by Roy L. DeVault and published by Devtronix Organ Products, 5872 Amapola Drive, San Jose, Calif. 95129.

SUMMARY OF THE INVENTION

The present invention and the inventor's pioneer disclosure entitled "Musical Instrument", U.S. Pat. No. 2,422,940, differ from all prior and subsequent systems of just intonation for keyboard instruments in that the tone producing elements are initially tuned to the scale of equal temperament and that keyboard controlled means are provided whereby all the thirds and sixths, alone or combined in chords, are rendered in almost perfect intonation automatically. Also, the minor sevenths are rendered as harmonic sevenths when they occur in dominant seventh or dominant ninth chords. As these automatic shifts of pitch are determined solely by the note combinations played, this automatic just intonation system may be referred to as an interval determined system of just intonation.

The classical art of singing a cappella is generally considered as conducive to the achievement of just intonation. Actually, this can be true only if the music is sung with moderate tempo and with a minimum of vibrato. Excessive vibrato on the part of all the members of a choir has the ffect of blurring distinctions of pitch so that the tonal spectrum is almost continuous and in such a tonal environment it is impossible for each member of the choir to sing with accurate intonation. However, some choirs and instrumental ensembles do make an effort to achieve more accurate intonation. This is especially true of quartettes because within a more intimate tonal environment it is easier to achieve accurate intonation by mutual pitch accomodation. The precedent for a more direct approach to just intonation by pitch variation on an interval by interval basis, as afforded by this invention, has therefore already been established by the performances of the best vocal and instrumental ensembles.

The chief object of this invention is to provide a novel system of automatic just intonation which can be easily incorporated in existing instruments having one or more conventional keyboards and having tone producing elements initially tuned to the twelve tone scale of equal temperament.

More specifically, an object of this invention is to provide a logic circuit which receives signals from the keying voltages of the keyboards through a diode branch circuit. The data thus gathered from simultaneously played keys is processed in terms of their content of thirds and sixths, whereupon outputs of the said logic circuit energize pitch shifting devices associated with the tone producing elements of the instrument for correcting the intonation of the notes played.

Another object is to dispense with the additional multicontact switches for operating the logic circuit as was disclosed in the inventor's prior U.S. patent. Instead, advantage can be taken of the direct current keying systems used in electronic organs whereby a very small portion of the current used for keying may also be used to operate the logic circuit.

Another object is to substitute solid state devices for the electromagnetic relays used in the inventor's prior invention.

Another object is to provide pitch shifting means controlled by the logic circuit for producing two degrees of pitch shift; a shift of about one seventh of a semitone for the thirds and sixths, and a shift of about three tenths of a semitone for the minor sevenths of dominant chords. The inventor's prior invention provided for only one degree of pitch shift for both classes of intervals.

Another object is to resolve anomalies arising from the novel combination of the diatonic and the septimal systems of harmony which this invention makes possible.

Another object, the attainment of which contributes greatly to the attainment of the foregoing objects, is to incorporate this invention in an electronic organ having printed circuit modules or large scale integrated circuit modules. With very little added expense, the circuit components for carrying out the invention could be added to the keying, tone generating and tone modifying circuits normally used in such modules. The advantage accruing therefrom would be that all the input and output connections for the added circuit components of this invention would be a built-in part of the other circuitry within the module and no additional outside wiring would be required.

Further objects will appear from the detailed description taken in connection with the drawings.

MUSIC THEORY UNDERLYING THE INVENTION

Figure 1:
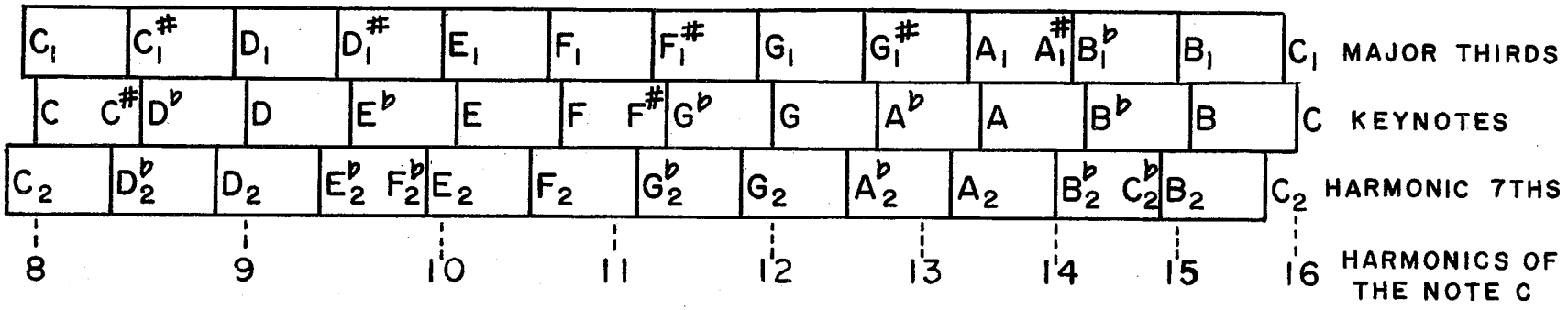
FIG. 1 is a diagram drawn to a logarithmic scale showing the relative pitches of all the notes in an octave of the equal tempered scale together with one set of notes in the upper scale which form just major thirds with notes in the middle scale and another set of notes forming harmonic sevenths with notes in the middle scale.

No chromatic scale with tones of fixed pitch can yield perfectly tuned chords and also allow complete freedom of modulation. A scale composed of perfectly tuned chords must have notes whose frequencies form an arithmetical progression, while if the scale is to allow complete freedom of modulation, the notes must have frequencies that form a geometrical progression. In the first case, although the frequency differences are all congruent, the sizes of the various intervals, measured logarithmically, are not congruent with respect to the octave or with one another because the logarithms of simple interval ratios are irrational decimals. In the second case the sizes of the intervals, measured logarithmically, are congruent with one another and with the octave but now, since the interval ratios are all expressed as fractional powers of two, and hence irrational, all the intervals of such a scale except the octave are more or less out of tune.

This dilemma which lies at the root of the difficulty of realizing just intonation with scales of fixed pitch, can be resolved by converting the present scale of equal temperament into a scale with tones of mutable pitch. Thus, the modulational advantage of the present scale is preserved by retaining the tempered fourths and fifths without alteration while the harmonic potentialities are greatly enlarged by the use of a keyboard controlled computer which automatically shifts the pitch of certain notes to correct the larger tuning errors of the scale.

In equal temperament the fourths are too wide and the fifths are too narrow by only 1.955 cents or one fiftieth of a semitone. With such a small tuning error they are practically indistinguishable from just fourths and fifths. They have the great advantage of allowing continuous modulations without the occurrence of overlapping notes as is the case with just fourths and fifths. The equal tempered major third is too wide and its inversion, the minor sixth, is too narrow, by 13.69 cents. Conversely, the minor third is too narrow, and its inversion, the major sixth, is too wide by 15.64 cents. On the average, therefore, the major thirds and the major sixths are too wide and their inversions, the minor sixths and the minor thirds, are too narrow by 14.66 cents, or about one seventh of a semitone.

The intonation computer of this invention automatically corrects these mistuned intervals, singly or combined in chords, by lowering the pitch of the top notes of major thirds or major sixths by a comma of one seventh of a semitone or, conversely, by lowering the pitch of the bottom notes of minor thirds or minor sixths by the same amount. For example, when B is played together with G and/or D, B is lowered in pitch by one seventh of a semitone to yield the combinations $GB_1$, $B_1D$ or $GB_1D$.

Another mistuned interval in equal temperament is the minor seventh in dominant seventh and dominant ninth chords. When used in this harmonic context it is too wide by 31.17 cents, or about three tenths of a semitone. Accordingly, the top note of the minor seventh is automatically lowered in pitch by three tenths of a semitone, or slightly more than two of the above commas, when it is a part of a dominant chord. For example, when F is played together with GB and/or BD, the pitch of F is automatically shifted to $F_2$ simultaneously with the shift of B to $B_1$, yielding the combinations $GB_1F_2$, $B_1DF_2$ or $GB_1DF_2$.

The minor seventh also occurs in two other harmonic contexts. No pitch shift occurs in the normal minor seventh GF or its inversion, the major tone FG. However, when the same minor seventh is played together with a third note $B^b$, the note G shifts to $G_1$ by virtue of forming a just minor third with $B^b$. The chord is therefore rendered as $G_1B^bF$. A slightly wider minor seventh $G_1F$ results which is the inversion of the minor tone $FG_1$.

As each note in the equal tempered scale may be shifted downward in pitch by one comma or by two commas, as described above, there will be 36 available pitches per octave consisting of three equal tempered scales. FIG. 1 illustrates the three scales drawn to a logarithmic scale to show the relative pitches of the notes. The normal pitches are represented by the middle scale. When an interval or chord is played, one or more notes will be shifted in pitch, a comma lower as in the upper scale or two commas lower as in the lower scale depending upon the structure of the chord. The upper and lower scales are therefore not distinct scales but represent the required pitch deviations from notes in the middle row when an interval or chord is rendered in just intonation. For the purpose of comparison, the fourth octave of the harmonic series from the eighth to the sixteenth harmonics has been inserted to show that the pitches of all the harmonics except the eleventh and the thirteenth are closely approximated by notes from the three scales.

Figure 2:
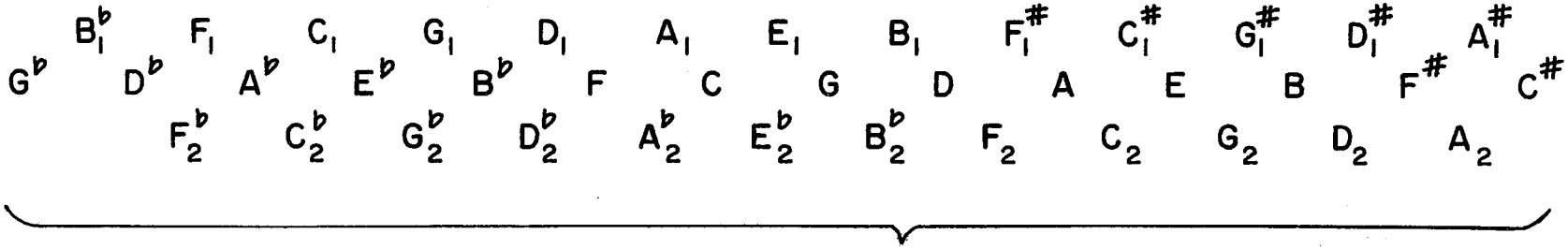
FIG. 2 is an array composed of most of the notes of FIG. 1 expanded to form three series of fifths such that harmonically related notes are positioned closely together.

In FIG. 2 notes from the three scales are arranged to form three series of equal tempered fifths in which the upper row contains notes that are a just major third above notes in the middle row and the lower row contains notes that are a harmonic seventh above notes in the middle row. This schematic arrangement clarifies the concept of close versus distant harmonic relationships between notes of the scale. Thus, the notes $FA_1$-$CE_1GB_1D$ from the just diatonic scale of C Major are a more compact group than the notes FACEGBD from the equal tempered scale of C Major found in the middle row. Likewise the harmonic relationships between notes of the dominant ninth chord $GB_1DF_2A$ are closer than those between the notes GBDFA found in the middle row.

Among the many microtonic temperaments advocated from time to time over many years by music theorists, the most important have been the cyclic meantone scale of 31 equal divisions of the octave and the cyclic pythagorean scale of 53 equal divisions of the octave. Many attempts have been made to construct keyboard instruments for each of these temperaments with keyboards having a corresponding number of digitals per octave. The 31 division system provides very good approximations to the major third and the harmonic seventh but the fifths are quite noticably flat. On the other hand, the 53 division system provides very good thirds, somewhat poorer harmonic sevenths and extremely good fifths all at the expense of an even more complex keyboard. The 84 division system, which is a synthesis (31+53=84) of these two systems has the best characteristics of both. It combines in one system the advantage of providing nearly perfect fifths, thirds and harmonic sevenths. Because it consists of seven distinct twelve tone scales, it is perfectly adapted for use with the conventional keyboard. The present invention, however, uses only three of the possible seven equal tempered scales with the further modification that, in order to obtain perfect harmonic sevenths, one equal tempered scale is slightly lower in pitch than it would be in the 84 division system. A further distinction to be made is that this invention does not utilize three distinct scales per octave as such but a scale of only twelve initial tones per octave, each one of which may vary in pitch as required to provide perfectly tuned intervals and chords.

A primary function of the logic circuit of this invention is to avoid a difficulty that arises because of a difference in structure of normal diatonic minor chords as compared with the structure of their septimal counterparts contained in dominant chords. Thus, if the inharmonious minor chord $DFA_1$ contained in the just scale of C Major were perfectly tuned it would be rendered as $D_1FA_1$. The difference between the chord $D_1FA_1$ and the chord $DF_2A$ is clearly shown in FIG. 2. The ideal frequency ratios between notes of the chord $D_1FA_1$ are 10:12:15. When this chord is part of a dominant ninth chord the logic circuit causes the note F to shift three tenths of a semitone lower to $F_2$ while the pitches of the notes D and A are unchanged so that the full chord is rendered as $GB_1DF_2A$. The ideal frequency ratios between notes of the chord $DF_2A$ are 6:7:9. The requirements for perfect diatonic harmony by which this chord is rendered as $D_1FA_1$ and for perfect septimal harmony by which this chord is rendered as $DF_2A$ can both be met if a portion of the signal due to the playing of the note B is routed into gates that inhibit the notes D and A from each shifting a comma lower in pitch to $D_1$ and $A_1$. Thus, the addition of the note B to the notes D, F, and A will cause the chord $D_1FA_1$ to change to the chord $B_1DF_2A$.

The various operations of the logic circuit thus far described largely in musical terms may be summarized by the following logic equations for notes in the tonality of C Major. Analogous equations may also be written for chords in other tonalities. The note symbols on the left side of each equation represent input signals to the logic circuit of FIG. 3, while those on the right side represent output signals. Under each equation is written an equivalent equation in which the note symbols are replaced by the corresponding number designations of the energized input and output busses in the logic circuit. All OR functions are understood to be inclusive OR functions:

| | |
|---|---|
| EQUATION NO. (1) | $(G + D)B = B_1$ |
| | $(7 + 2)11 = 23$ |
| EQUATION NO. (2) | $(G + D)B \,.\, F = B_1 \,.\, F_2 \,.\, \overline{D_1}$ |
| | $(7 + 2)11 \,.\, 5 = 23 \,.\, 29 \,.\, \overline{14}$ |
| EQUATION NO. (3) | $(D + A)F = D_1 + A_1$ |
| | $(2 + 9)5 = 14 + 21$ |
| EQUATION NO. (4) | $(G + D)B \,.\, (D + A)F = B_1 \,.\, F_2 \,.\, \overline{D_1} \,.\, \overline{A_1}$ |
| | $(7 + 2)11 \,.\, (2 + 9)5 = 23 \,.\, 29 \,.\, \overline{14} \,.\, \overline{21}$ |

Figure 3:
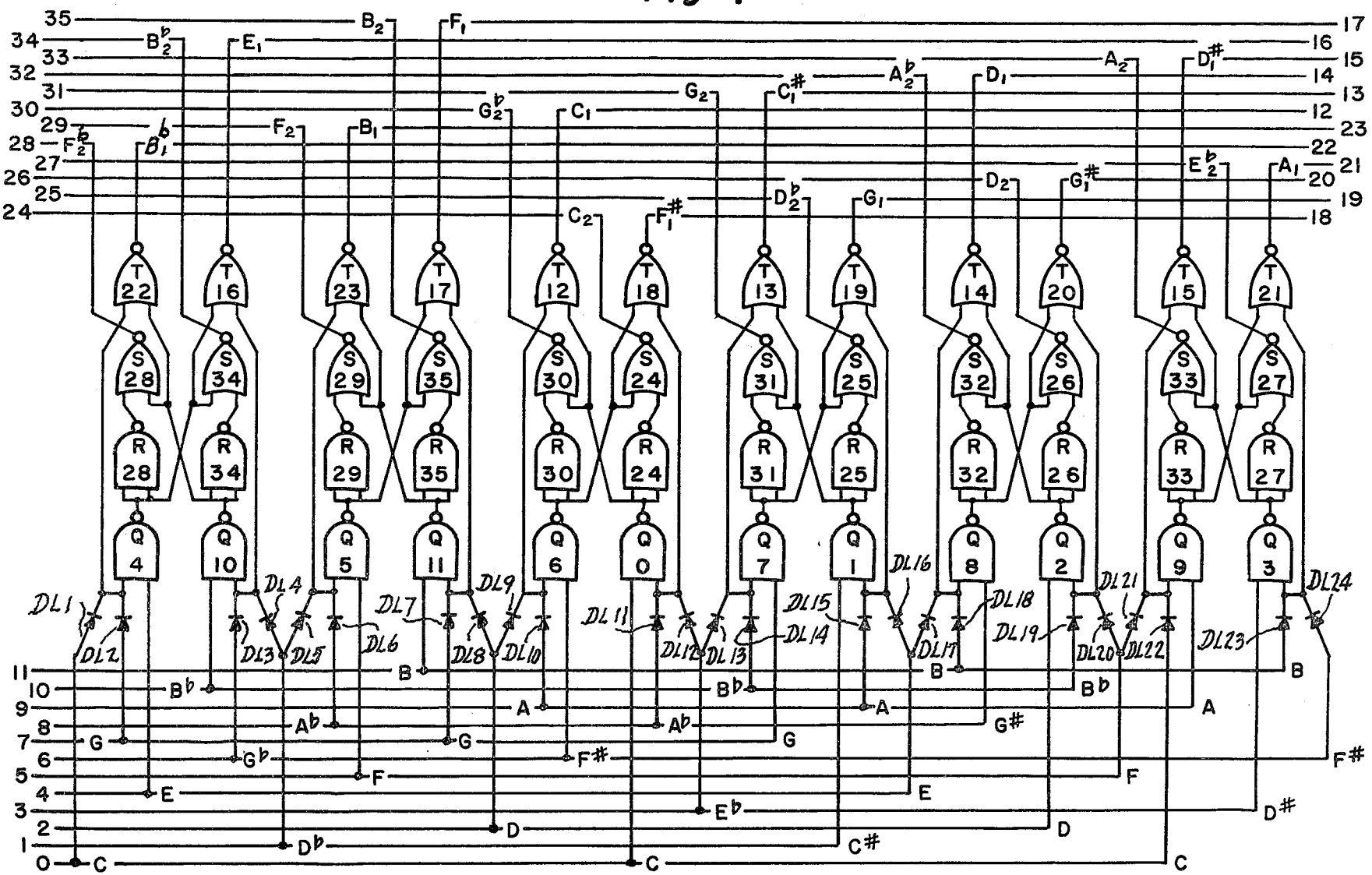
FIG. 3 is a schematic diagram of the complete logic circuit of this invention.

The foregoing equations are applicable to all note combinations contained in the dominant ninth chord $GB_1DF_2A$ in the key of C Major. When the circuit of FIG. 3 is analyzed in greater detail, it will be apparent that it has complete circular symmetry and therefore Mod 12 concepts, well known in the art, are applicable to it. Therefore, each of the above equations represents only one of twelve equations that can be written for each of the twelve transpositions of any given chord. If the corrections of intonation that occur for any given chord are known, then by analogy, the same corrections of intonation will also be known for all of the twelve transpositions of the same chord.

There are two other well known chords which, for the purpose of this invention, will be regarded merely as altered dominant seventh chords although the same chords may be derived by altering other chords. One chord is the diminished seventh chord such as G#BDF which is derived from the chord GBDF and the other is the augmented sixth chord D♭FGB which is derived from the chord DFGB. Strictly speaking, the first chord consists of two diminished fifths while the second chord consists of two augmented fourths or two tritones.

The chord G#BDF may resolve into any one of four different major and four different minor keys and likewise the chord D♭FGB may have a variety of resolutions. In view of this ambiguity, and also because of the inherent dissonance of both chords, the logic circuit has been designed to render both chords in equal temperament, thus avoiding the following contradictory responses. For example, the possibility exists that each note of the chord G#BDF will be lowered in pitch by either one comma or by two commas. This chord contains four triads one of which would be rendered as $B_1DF_2$ in accordance with equation (2). By analogy, the other three triads contained in this chord, if properly spelled, would be rendered as $A_2{}^{\flat}D_1F$, $A^{\flat}C_2{}^{\flat}F_1$, and $G^{\#}{}_1BD_2$. Thus, a note such as F might have any one of three pitches, F, $F_1$, or $F_2$, and similarly the other notes of the diminished seventh chord may each have any one of three different pitches. This confusion of responses is resolved by the expedient of providing an inhibit function whereby the signals $F_1$ and $F_2$ mutually cancel each other. As this provision applies equally and simultaneously to all four notes, this diminished seventh chord will be rendered in its equal tempered version as G#BDF.

In accordance with equation (2) the notes F, G and B contained in the augmented sixth chord D♭FGB would ordinarily be rendered as $F_2GB_1$. By analogy, the notes D♭, F and B would be rendered as $D^{\flat}F_1B_2$. Here again, inhibit gates simultaneously receiving the signals $F_1$ and $F_2$, function to restore the original pitch F and other inhibit gates receiving the signals $B_1$ and $B_2$, function to restore the original pitch B. The above augmented sixth chord is therefore rendered in its equal tempered version as D♭FGB. Having thus set forth the chief functions of the logic circuit largely in musical terms, its electrical operation in a preferred embodiment will now be described.

DESCRIPTION OF THE PREFERRED EMBODIMENT

It will be understood that the present invention falls within a board class of control systems performing three functions, namely, data gathering, data processing, and control. A major aspect of this invention is the use of a diode branch circuit for gathering data as to the content of major and minor thirds or any inversion thereof in chords and the use of a data processing unit or logic circuit for selecting which of the played notes will be altered in pitch to render the chord more consonant. On the other hand, the control function can be performed by a large variety of pitch shifting devices each appropriate to the kind of keyboard instrument in which they are used. Therefore, the scope of the invention includes many types of keyboard instruments.

This invention is preferably embodied in an electronic organ of the type having twelve master oscillators in the top octave which drive chains of frequency dividers in the lower octaves. In such organs any note together with all its octavely related notes are simultaneously shifted in pitch merely by changing the frequency of the corresponding master oscillator. It will be understood, however, that this invention can also be embodied in an electronic organ with independently tuned tone generators if means are provided whereby the frequencies of octavely related tone generators may be simultaneously shifted to the same degree.

In the present state of the art it is possible to dispense with separate master oscillators in a divider type organ. This may be done by means of an integrated circuit that synthesizes the frequencies of the equal tempered scale for the top octave from a single 4 megahertz clock. This expedient would seem quite attactive due to reduced manufacturing costs, ease of transposition to any absolute pitch without altering the interval ratios and, if the tuning errors of equal temperament are not taken into account, such an organ can never "get out of tune". Although the present invention requires the use of twelve master oscillators of high frequency stability, and provides a keyboard controlled logic circuit for varying those frequencies, the ability of such an organ to yield perfectly tuned intervals and chords is a significant advance in the art which cannot be realized with an instrument in which the interval ratios are unalterably fixed.

Figure 4:
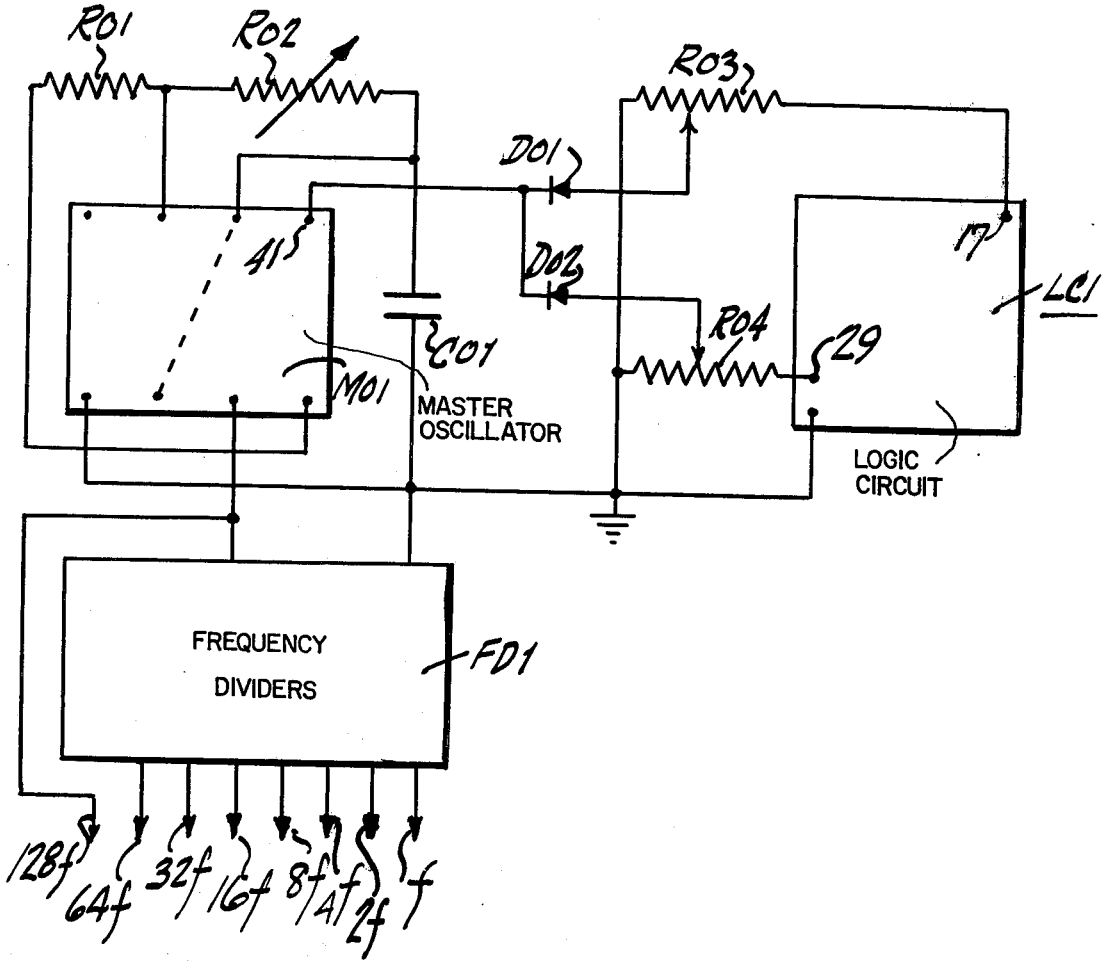
FIG. 4 is a partial block diagram showing one form of master oscillator and its associated frequency dividers together with one form of adjustable pitch shifting circuit controlled by the logic circuit whereby the frequency of the master oscillator may be altered by one comma or by two commas.

FIG. 4 shows a preferred two input pitch shifting means for one of the master oscillators, MO1, in this case the one for the note F. The preferred master oscillator shown, exemplary of any other type of oscillator, is the highly stable 555 integrated circuit timer together with an external network consisting of resistor RO1, variable resistor RO2 and capacitor CO1. The initial frequency or absolute pitch of the oscillator is set by adjusting variable resistor RO2. The frequency can be further varied either by changing variable resistor RO2 or by changing capacitor CO1, but in the preferred embodiment advantage can be taken of the fact that type 555 integrated circuit can also function as a voltage controlled oscillator so that the frequency can more effectively be lowered by applying a positive voltage to terminal 41. Since the logic circuit LC1 consists preferably of CMOS integrated circuits, the logic levels of outputs 17 and 29 thereof are either at zero voltage or the same positive voltage as the power supply when high. The voltage level at control voltage terminal 41 can be adjusted by means of potential divider RO3 so that when output 17 goes high the pitch of master oscillator MO1 will change, for example, from F to $F_1$. Likewise, the voltage level at terminal 41 can be adjusted by means of potential divider RO4 so that when output 29 goes high, the pitch of the master oscillator will be lowered by two commas from F to $F_2$. Isolation diodes DO1 and DO2 not only insure that the potential dividers will not bias the internal trigger level of the oscillator toward ground, but also that the setting of one potential divider will not affect the voltage output from the other potential divider. As was mentioned hereinbefore and which will be described in greater detail, output terminals 17 and 29 cannot go high simultaneously and therefore only two degrees of pitch shift can occur. The output of master oscillator MO1 is connected to the input of frequency divider FD1.

Figure 5:
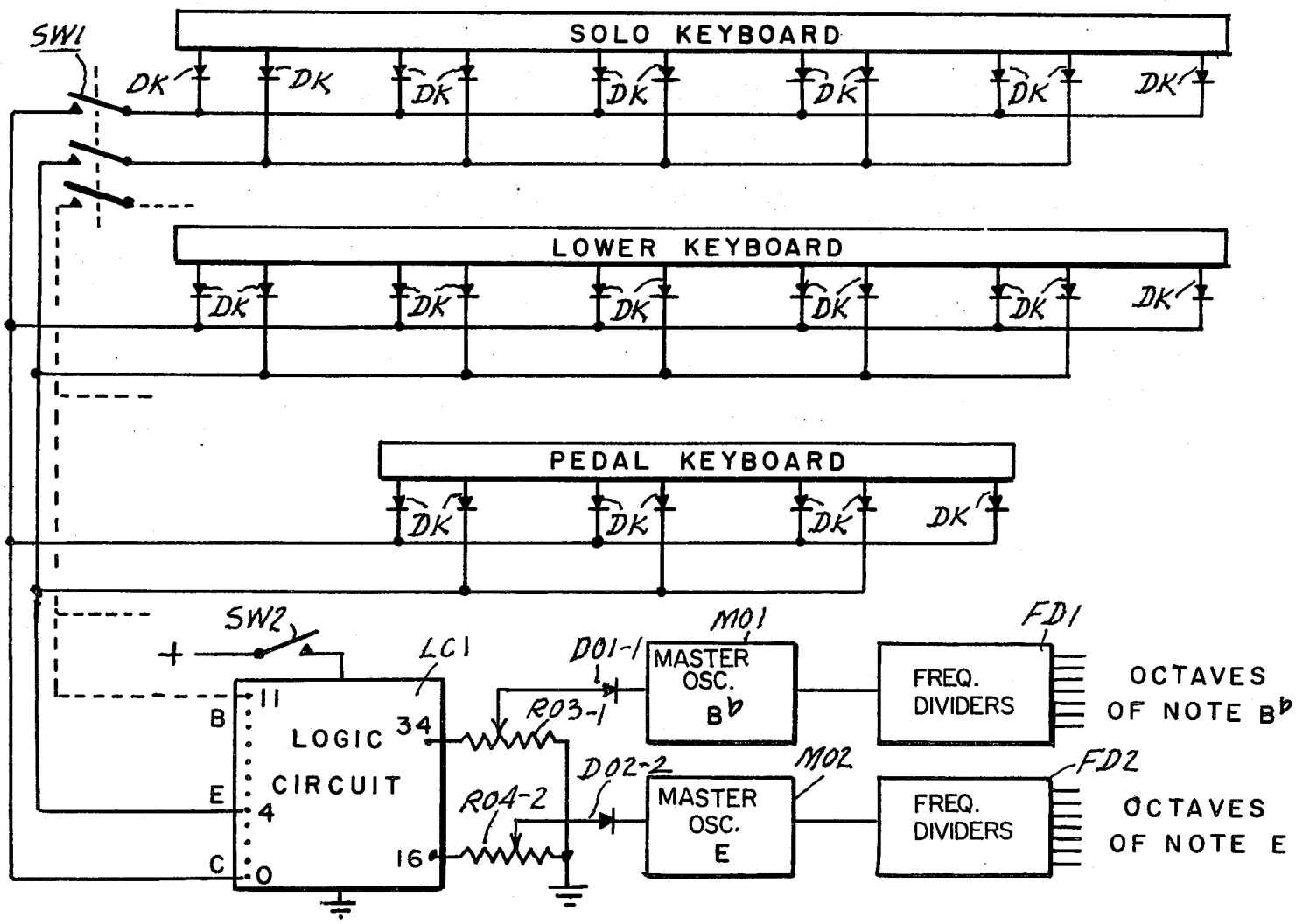
FIG. 5 is a partial block diagram illustrating two of the twelve diode branch circuits for interfacing the logic circuit with a plurality of keyboards.

Direct current keying systems afford a convenient means of operating the logic circuit without the necessity of providing additional keyboard switches for this purpose. However, diode branch circuits will be required for interfacing all key switches of one or more keyboards with the twelve inputs of the logic circuit. With reference to FIG. 3, the logic circuit has twelve input busses corresponding to the twelve notes of the chromatic scale from C up to B, which are also labelled with the numerals 0 through 11, respectively. As shown in the partial block diagram of FIG. 5, each input of a given nomenclature, for example input bus 0 for the note C, is connected to all of the keyboard switches for the note C through a diode branch circuit so that the playing of any one C digital or combination of C digitals is equally effective to energize the single input 0 of the logic circuit. For the sake of simplicity, only two of the required twelve diode branch circuits are shown, one for the note C and the other for the note E. As shown in FIG. 5, the twelve diode branch circuits encompass a plurality of manuals and include the pedal keyboard as well. For certain music replete with grace notes and arpeggios it may be more advantageous to disconnect from the logic circuit the manual on which such passages are played and allow another manual on which the accompanying harmony is played to control the intonation. For this purpose a twelve pole switch SW1 is provided. Another valuable feature of this invention is that a choice may be made between just intonation or equal temperament by switching on or off the operating current for the logic circuit with switch SW2. The ease with which the sound of tempered versus justly intoned intervals and chords may be thus compared would be of value of teachers of harmony and music theory.

In the design of the logic circuit, an economy of circuit interconnections is realized by grouping together the logic gates associated with each major triad and its counterpart transposed by a tritone. Thus, at the left side of FIG. 3, the logic gates required to correct the intonations of the chord CEG and those required to correct the intonation of the chord $G^{\flat}B^{\flat}D^{\flat}$ are contained within the same integrated circuit packages. The entire circuit, therefore, consists of six smaller circuits referred to as "basic circuits". The fact that the logic circuit can be easily subdivided into six such basic circuits has an application which will be described in connection with FIG. 6.

All six basic circuits are identical in form such that one of the inputs to NAND gates Q through Q11 are associated with the third of each major triad and pairs of diodes connected to the other inputs of those NAND gates are associated with the primes and fifths of each major triad. This may be verified for each chord in the following circle of just major triads: $G^{\flat}B_1{}^{\flat}D^{\flat}$, $D^{\flat}F_1A^{\flat}$, $A^{\flat}C_1E^{\flat}$, $E^{\flat}G_1B^{\flat}$, $B^{\flat}D_1F$, $FA_1C$, $CE_1G$, $GB_1D$, $DF_1{}^{\#}A$, $AC_1{}^{\#}E$, $EG_1{}^{\#}B$ and $BD_1{}^{\#}F^{\#}$. This list brings out the fact, well known to musicians, that in most flat key signatures the flattened notes serve as primes, fourths, fifths and ninths of each major scale, while in most sharp key signatures the sharped notes serve as thirds, sixths and leading tones of each major scale.

Only when both inputs of a NAND gate Q are high or logic 1 can its output be low or logic 0. With both their inputs connected together, NAND gates R function only as inverters. NOR gates S and T function both as inverters and as inhibit gates. For the sake of simplicity, the required resistors between all inputs of gates Q and ground are not shown. A detailed description of the operation of the logic circuit will now be given in connection with the logic equations (1) through (4).

The analysis of the logic states existing in various parts of the logic circuit when certain note combinations are played, will be facilitated by the use of the following notation: The logic states of the inputs of a gate will be written in parentheses to the left of the letter designation of the gate and the resulting logic state of the output will be written in parentheses to the right, as for example, (0) (1)T23(0). The same notation will be used to indicate the logic state of a bus, as for example, 2(0). The "dont care" state will be designated by X which represents either state 1 or state 0. Thus (0) (1)T23(0) or (1) (1)T23(0) can be written as (X) (1)T23(0).

Equation (1) states that $(G+D)B=B_1$. When these notes are played, inputs 2 and/or 7 together with input 11 are all logic 1 so that the logic levels for NAND gate Q11 are expressed by (1) (1)Q11(0). Hence one of the inputs to NOR gate T23 is logic 0. The other input to NOR gate T23 is also logic 0 because unused input busses 1 and 8 are low or logic 0. Therefore the result is (0) (0)T23(1). Output bus 23 now being high or positive, the tuning means for note B acts to lower its pitch to $B_1$. This may be concisely expressed as (0) (0)T23(1)$=B_1$. A portion of the logic 0 output of NAND gate Q11 also enters one of the inputs of NOR gate S29. Since unused input busses 1,5, and 8 are also logic 0, the result is (0) (0)Q5(1) which, by inversion by gate R29, is (1)R29(0) so that (0) (0)S29(1)$=F_2$. This means that, although note F is not being played, the pitch of the master oscillator for that note has shifted from F to $F_2$.

Equation (2) states that $(G+D)B\cdot F=B_1\cdot F_2\cdot\bar{D}_1$. The same analysis as that above can also be applied to equation (2) except that the note F has been added and is heard as $F_2$. In addition to the major third GB and the minor third BD, this equation also takes into account the presence of the minor third DF. As before, bus 2(1) and/or bus 7(1) together with bus 11(1) function to produce $B_1$ and $F_2$. Also, because of bus 2(1) and the additional bus 5(1), the result is (1) (1)Q2(0), and therefore one of the inputs to NOR gate T14 is (0). However, the other input to NOR gate T14 is connected to bus 11(1) so that (0) (1)T14(0)$=\bar{D}_1=D$. Thus, the playing of note B together with DF prevents DF from being tuned as $D_1F$. When the notes G and/or D are played together with B and F, the possible combinations are $GB_1F_2$, $B_1DF_2$, and $GB_1DF_2$.

Equation (3) states that $(D+A)F=D_1+A_1$ (Inclusive OR). With bus 2(1) and bus 5(1), therefore (1) (1)Q2(0); and with bus 4(0) and bus 11(0), therefore (0) (0)T14(1)$=D_1$. With bus 5(1) and bus 9(1), therefore (1) (1)Q9(0); and also with bus 6(0) and bus 11(0), therefore (0) (0)T21(1)$=A_1$. The possible combinations are therefore $D_1F$, $FA_1$ or $D_1FA_1$.

NOR gates T14 and T21 have one input in common, namely bus 11(1), so that by including note B with notes D, F, and A, (0) (1)T14(0)$=\bar{D}_1=D$, and (0) (1)T21(0)$=\bar{A}_1=A$. Also B together with D yield $B_1$ and $F_2$ in accordance with equation (2). Therefore the inclusion of the note B with the notes D, F, and A changes the diatonic minor triad $D_1FA_1$ into the septimal chord $B_1DF_2A$ which is a dominant ninth chord without its root. The above analysis is not changed by the inclusion of the note G with notes B, D, F, and A as in equation (4) which states that $(G+D)B.(D+A)F=-B_1\cdot F_2\cdot\bar{D}_1\cdot\bar{A}_1$. The possible combinations are $B_1DF_2$, $B_1DF_2A$, $GB_1F_2A$, or $GB_1DF_2A$.

The inhibit functions that operate when a chord contains two tritones, previously described only in musical terms, are now better understood with reference to the logic circuit of FIG. 3. The analysis of the diminished seventh chord G♯BDF will at first be confined to the notes B, D, and F after which the same analysis can be applied to the other note combinations in the chord by appealing to analogy because of the inherent symmetry within this circuit.

As both inputs B and D are logic 1, (1) (1)Q11(0); and as 1(0) and 8(0) therefore (0) (0)T23(1)$=B_1$. Also because 1(0), 8(0) and 5(1); (0) (1)Q5(1) so that (1)R29(0); therefore (0) (0)S29(1)$=F_2$. Because (1) (1)Q11(0) so that (0)R35(1); therefore (X) (1)S35 (0)$=\bar{B}_2$. For the single note D or 2(1), (X)(1)T17(0)$=\bar{F}_1$. Therefore expressed in a logic equation, $B \cdot D = B_1 \cdot F_2 \cdot \bar{B}_2 \cdot \bar{F}_1$. By analogy, $D \cdot F = D_1 \cdot A_2{}^{\flat} \cdot \bar{D}_2 \cdot \bar{G}_1{}^{\#}$. Also $F \cdot G^{\#} = F_1 B_2 \cdot \bar{F}_2 \cdot \bar{B}_1$. And also G♯19 $B = G_1{}^{\#} \cdot D_2{}^{\flat} \cdot \cdot \bar{A}_2 \bar{D}_1$. As a result, when all four notes G♯, B, D, and F are played together, the single comma shifts $G_1{}^{\#}$, $B_1$, $D_1$, and $F_1$ are prevented as are also the double comma shifts $A_2{}^{\flat}$, $B_2$, $D_2$, and $F_2$, so that the chord remains tuned in its equal tempered form G♯BDF.

The analysis of the chord D♭FGB is as follows: For the two notes G and B, (1) (1)Q11(0), and as 1(0) and 8(0), therefore (0) (0)T23(1)$=B_1$. As 1(0) and 5(0), (0) (0)Q5(1) so that (1)R29(0); Therefore (0) (0)S29(1)$=F_2$ Also because (1) (1)Q11(0) so that (0)R35(1), therefore (X) (1)S35(0)$=\bar{B}_2$. For the single note G or 7(1), (X) (1)T17(0)$=\bar{F}_1$. Therefore expressed in a logic equation, $G\ B = B_1 \cdot F_2 \cdot \bar{B}_2 \cdot \bar{F}_1$. As the only other third present in the chord is D♭F, by analogy, $D\flat \cdot F = F_1 \cdot B_2 \cdot \bar{F}_2 \cdot \bar{B}_1$. As a result, when all four notes are played together, the single comma shifts $B_1$ and $F_1$ are prevented as are also the double comma shifts $B_2$ and $F_2$, so that the chord is rendered in its equal tempered form D♭FGB.

It will now be apparent to those skilled in the art that, due to the circular symmetry within the logic circuit, any chord may be played in all of its twelve transpositions and in all cases the corrections of intonation will be identical in form. Due also to the fan in of octavely related signals from the keyboard to the logic circuit and the already existing fan out of the pitch control from each master oscillator to its octavely related tone generators, identical corrections of intonation will occur in a given chord however its notes are distributed over the keyboard.

As mentioned previously, an economy of circuit interconnections within the logic circuit is afforded by grouping together the logic gates associated with each major triad and its counterpart transposed by a tritone. In a similar manner, but on a larger scale, the design of an electronic organ may be much simplified by the use of identical modules. Modular design is particularly appropriate in an electronic organ because of the extensive duplication of parts. Instead of centralizing each circuit function such as tone generation in a single unit and another function such as keying in another unit, etc., much of the complex wiring between large single function units may be eliminated by breaking up the various functional units into smaller units and assembling them within a number of identical printed circuits or as large scale integrations. One such system of modular design is described in U.S. Pat. No. 3,755,609 to David Millet and Ray B. Schrecongost. In this disclosure all the circuits required for two adjacent notes such as C and C♯ are contained within a single module so that six such modules suffice for the entire gamut of tones and their associated tone modifying circuits in the organ.

Figure 6:
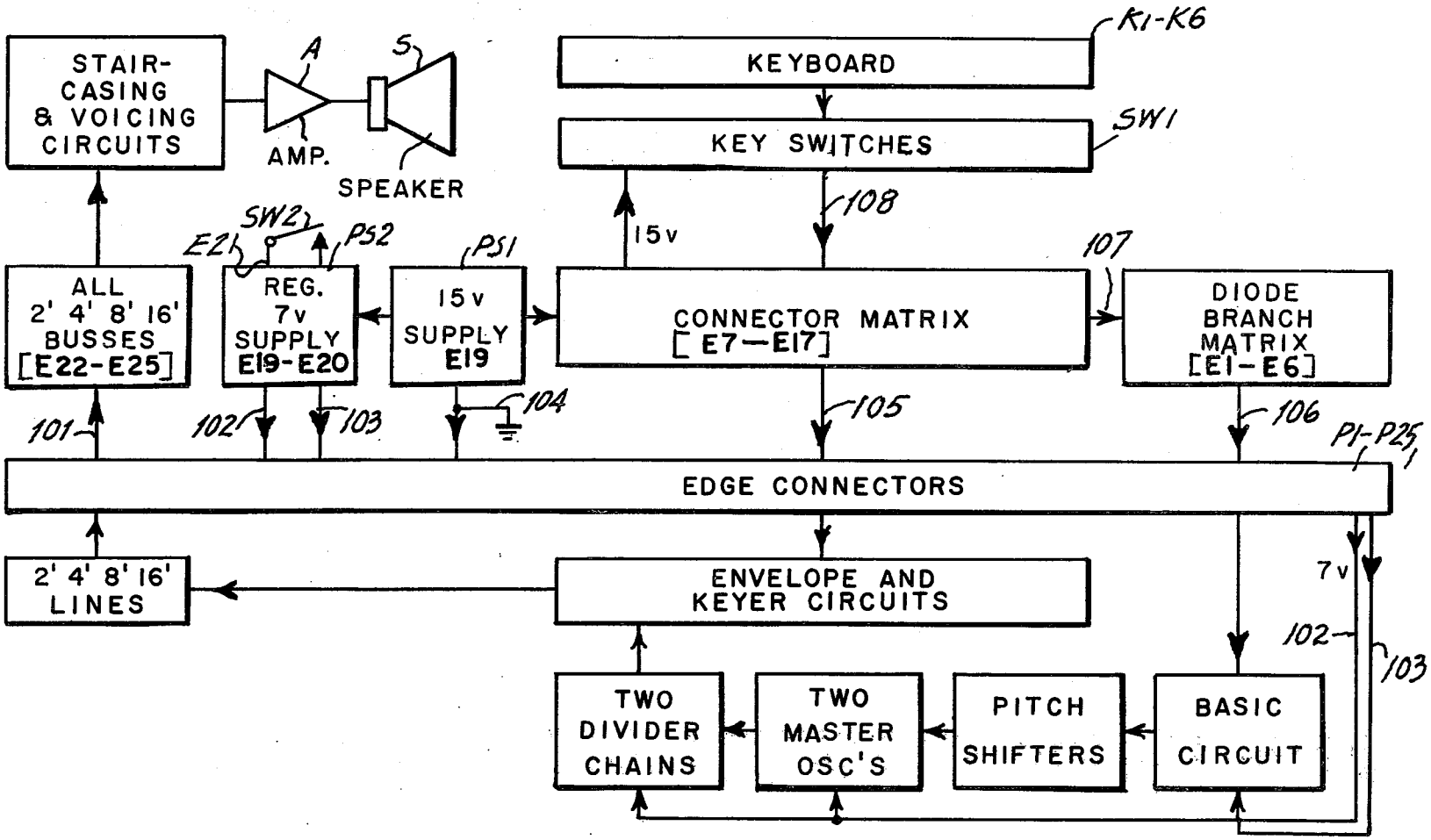
FIG. 6 is a block diagram illustrating the arrangement of circuit elements in one of six identical modules, a circuit design which would minimize the complexity of wiring between large single function units in an organ.

With reference to the block diagram of FIG. 6, the present invention also envisages the use of 6 plug-in modules. Each printed circuit module contains one basic circuit; two master oscillators MO1 and MO2; their two pitch shifters; a seven stage frequency divider for each oscillator, FD1 and FD2; keyer and envelope circuits for the seven octaves of square waves from each divider; and 2′, 4′, 8′ and 16′ lines from the keyer. The card edge contacts on the module, represented by the long block, mate with one of six rows of connectors on the mother board.

On the mother board each row of connectors consists of the following: Four connectors for gathering 2′, 4′, 8′, and 16′ tone signals from each module represented by line 101; two connectors for supplying a regulated voltage to the basic circuit, master oscillators and dividers of the module represented by lines 102 and 103; one connector for the common ground of the system represented by line 104; 11 connectors on the connector matrix for direct current signals from tritone related key switches of the keyboard, (for example, 6-C s and 5-F♯s) represented by line 105; and 6 connectors for signals from the diode branch circuits into the 6 inputs of the basic circuit represented by line 106. The diode branch circuits which are not shown are coextensive with the connector matrix of the mother board and have twelve busses, represented by line 107, which are connected to the various connectors of the diode branch matrix. The diode branch matrix consists of 6 rows of connectors having 6 connectors in each row. In common with many other mother board designs used in the art, the connector matrix has a network of diagonal interconnections, of which a total of 66 are required for the 6 rows of connectors, with 11 connectors in each row. Because of the 61 key switch connections of a five octave keyboard, represented by line 108, into the connector matrix, 5 of the 66 connectors are unused. The connectors in the diode branch matrix also have diagonal interconnections. Because each module is connected to the same footage busses, the same regulated voltage source and the same ground, all those connectors have transverse interconnections. Line 102 represents a continuous source of regulated voltage for the master oscillators and dividers while line 103 represents the same source of voltage for all the basic circuits which may be turned on or off with remote switch SW2 to enable the player to select just intonation or equal temperament.

Figure 7:
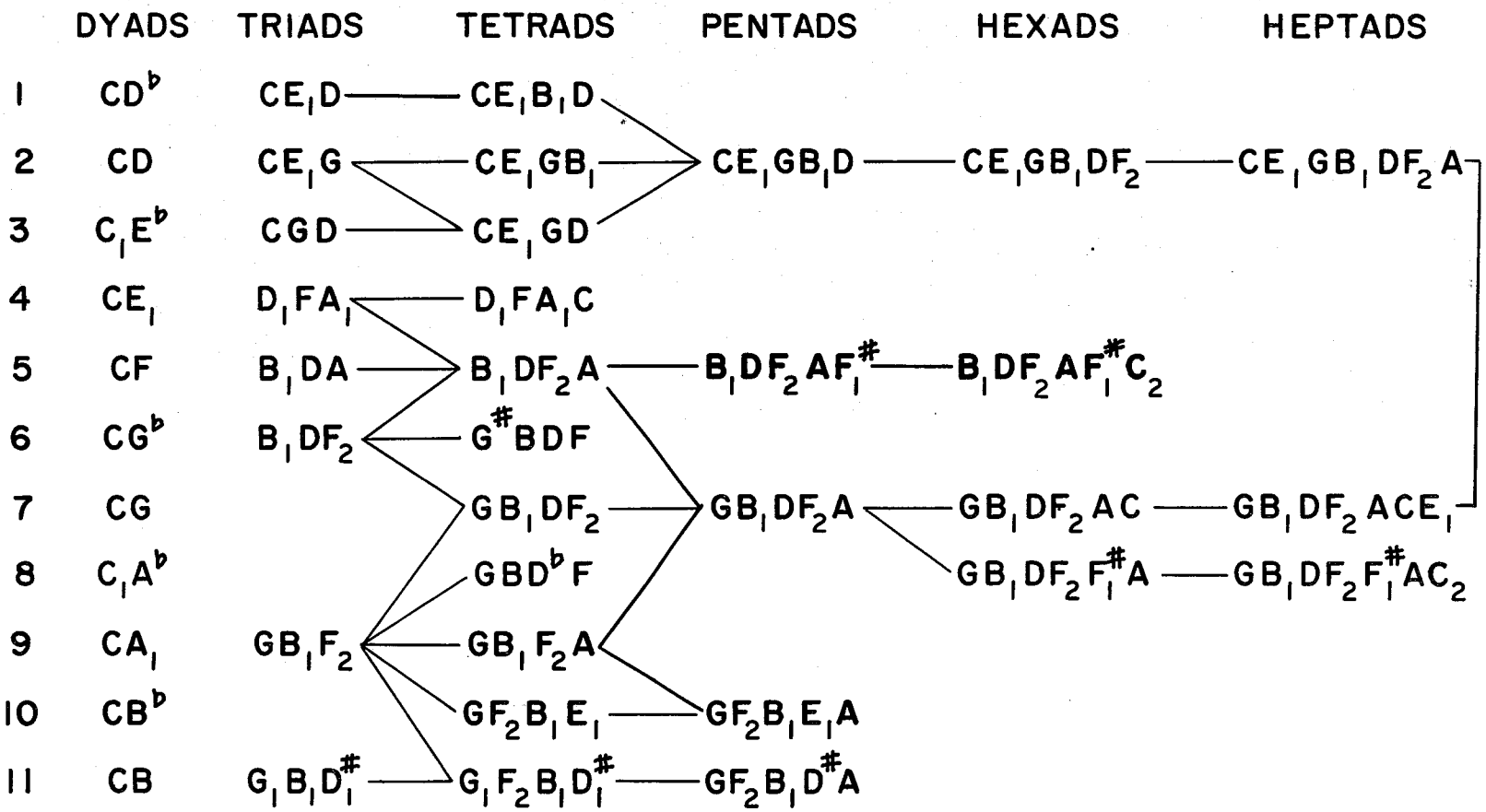
FIG. 7 is a lineage chart of a large variety of chords in the key of C Major formed by successive additions of notes to a few basic triads and showing by subscripts how each chord is intoned by the just intonation computer.

The versatility of the just intonation computer is not limited to the rendition of simple major chords, minor chords or septimal chords in just intonation but extends to a large variety of more complex chords listed in the table of FIG. 7. The chords connected by lines are sequences formed by successive additions of notes to a few basic types of triads. For the sake of clarity, all the chords listed belong to the tonality of C Major, but the same scheme of interrelated chords can be constructed for any of the other eleven tonalities.

Most of the chords have notes arranged in chains of major and minor thirds, and as a result they contain commatic notes separated by a fourth or fifth as, for example, the tetrad of row 2 ($CE_1GB_1$) or the tetrad of row 4 ($D_1FA_1C$). Indeed, a composite chord may also contain septimal notes separated by a fourth or fifth. In all such cases two parts of the logic circuit can function independently without interference. For example, the seventh chord $GB_1DF_2$ may be combined with the seventh chord $DF_1{}^{\#}AC_2$ to form the complex chord $GB_1DF_2F_1{}^{\#}AC_2$ or the heptad of row 8. Two ninth chords may also be combined to form an octad such as $GB_1DF_2F_1{}^{\#}AC_2E$, but in close formation both of these chords would be too dissonant to be of any musical value. However, if two major chords or two septimal chords are separated by the interval of a perfect twelfth, the musical effect is similar to that resulting when a chord is played with the quint stop of an organ turned on, except that the upper chord will be as loud as the principal chord. Many such "quint chords" produce novel and pleasing effects in just intonation while the same chords in equal temperament sound harsh by comparison. Variations of such quint chords may therefore be of interest to composers who wish to exploit more fully the harmonic potentialities latent among the upper members of the harmonic series rendered in just intonation.

If the leading tone to the dominant is added to the dominant ninth chord to form the chord $GB_1DF_2AF_1^{\#}$, or the hexad in row 8, the pitches of all the odd harmonics of the low note G through the 15th harmonic are represented, except the 11th and 13th harmonics. Its ideal ratio numbers are 4:5:6:7:9:15 and, in spite of the expected dissonance between notes $F_2$ and $F_1^{\#}$, it is surprisingly consonant.

The tonic thirteenth chord $CE_1GB_1DF_2A$, or heptad of row 2, contains all seven notes of the C Major scale and is of interest because it is composed of a perfect major triad, a perfect minor triad and a perfect dominant ninth chord. Its ideal frequency ratios are 8:10:12:15:18:21:27 and it is more harmonious than another inversion of the same chord, the dominant thirteenth chord $GB_1DF_2ACE_1$ or the heptad of row 7, whose ideal frequency ratios are 12:15:18:21:27:32:40.

Another chord of interest is the hexad of row 5. By contrast with the dominant ninth chord $GB_1DF_2A$ which is composed of a diatonic major triad and a septimal minor triad, this chord is composed of a diatonic minor triad $B_1DF_1^{\#}$ and a septimal major triad $F_2AC_2$ whose ideal interval ratios are 10:12:15 and 14:18:21 respectively. On the other hand, $B_1DF_2AF_1^{\#}$, the pentad of row 5 is composed of two minor triads; a diatonic minor triad $B_1DF_1^{\#}$ and a septimal minor triad $DF_2A$.

An example of a closely spaced quint chord or tone cluster is the combination $F_2F_1^{\#}GAB_1C_2$ composed of the two triads $F_2GB_1$ and $F_1^{\#}AC_2$. Its ideal frequency ratios are 14:15:16:18:20:21. When played in the high treble with a rich tone quality it produces a harmonious drone of beatnotes with the corresponding frequencies 1:2:3:4:5:6:7, but the same chord played in equal temperament is extremely discordant.

Figure 8A:
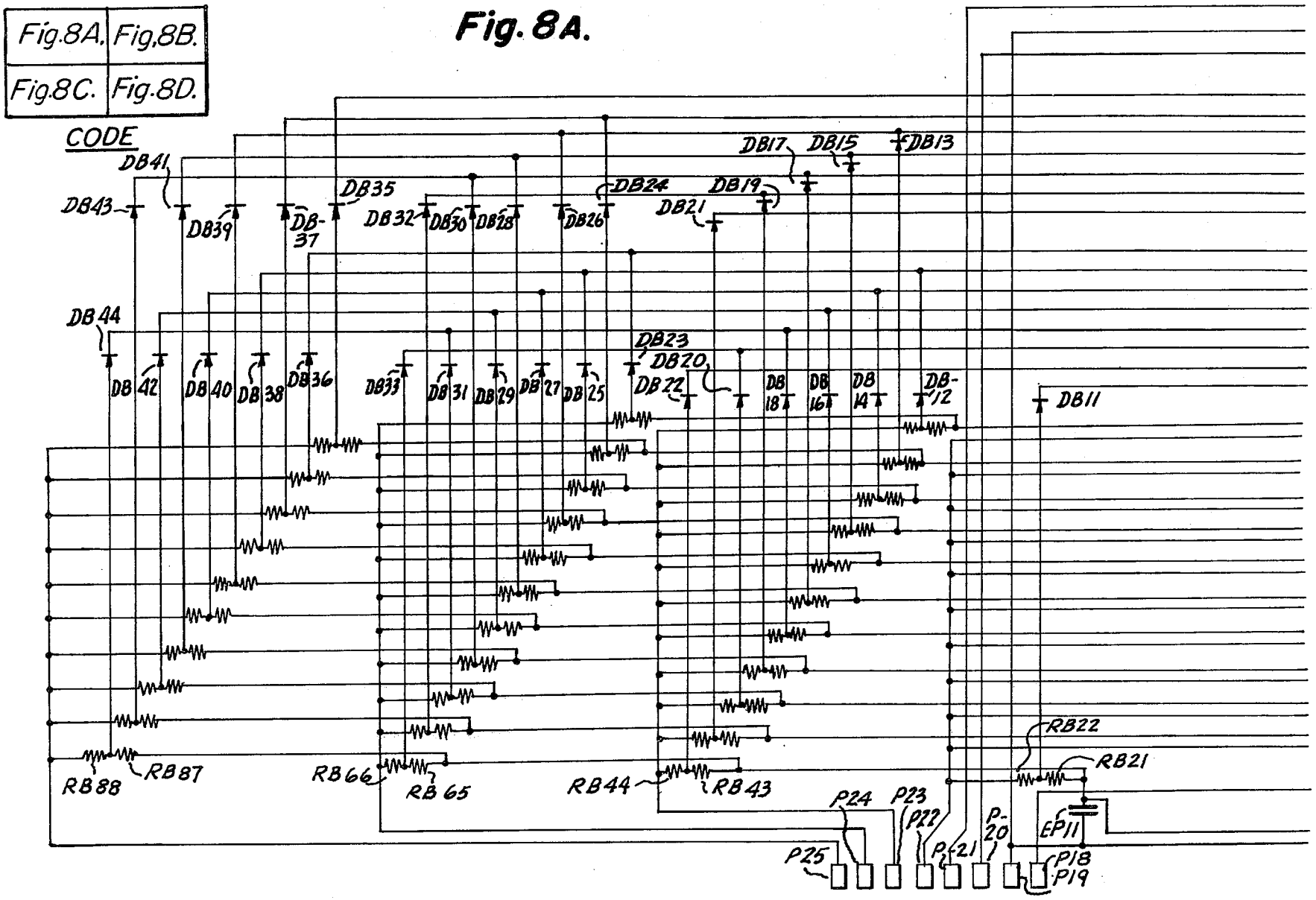
FIGS. 8A and 8B is a split schematic of any one of the six basic plug-in modules.
Figure 8B:
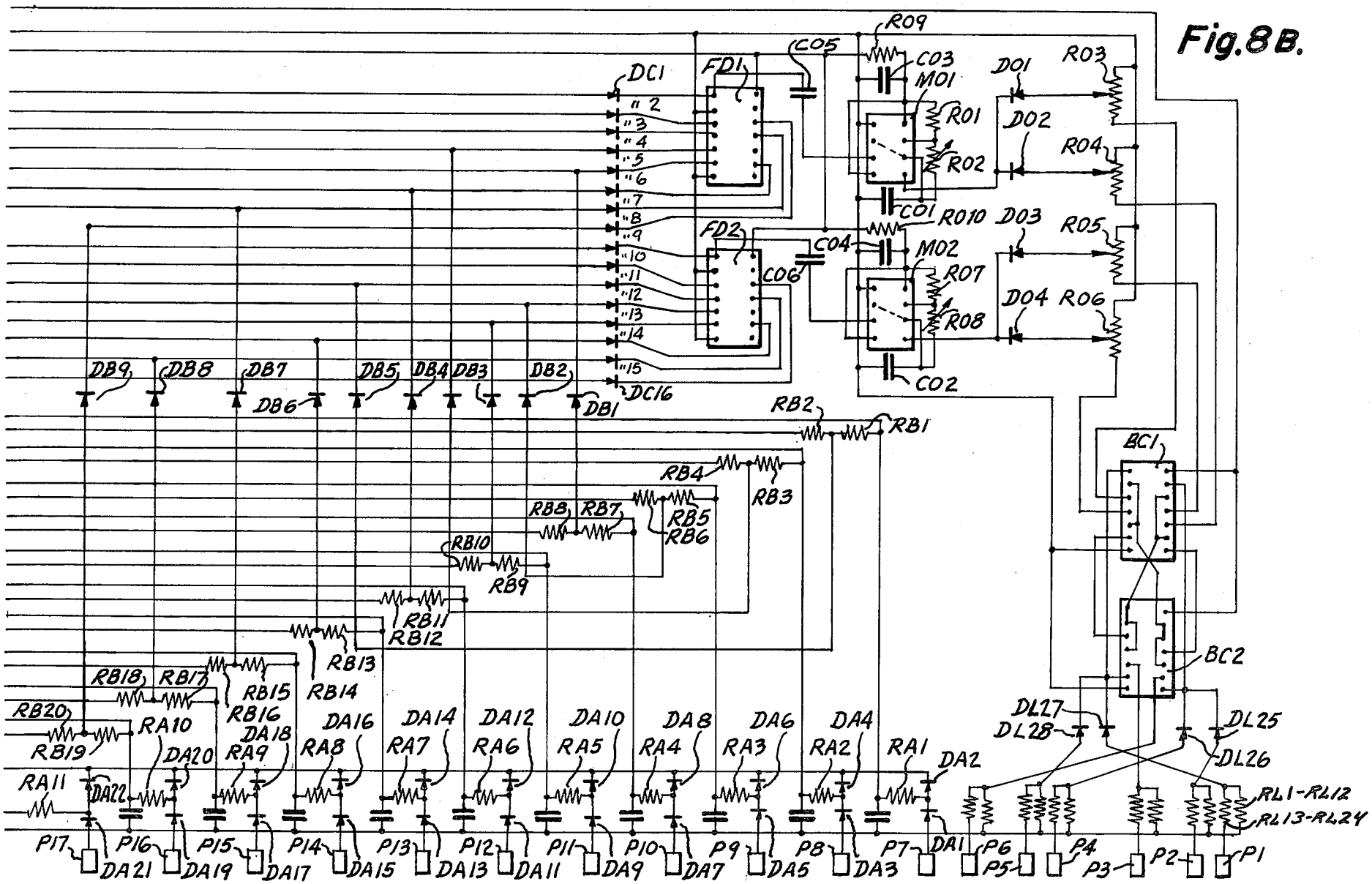
Figure 8C:
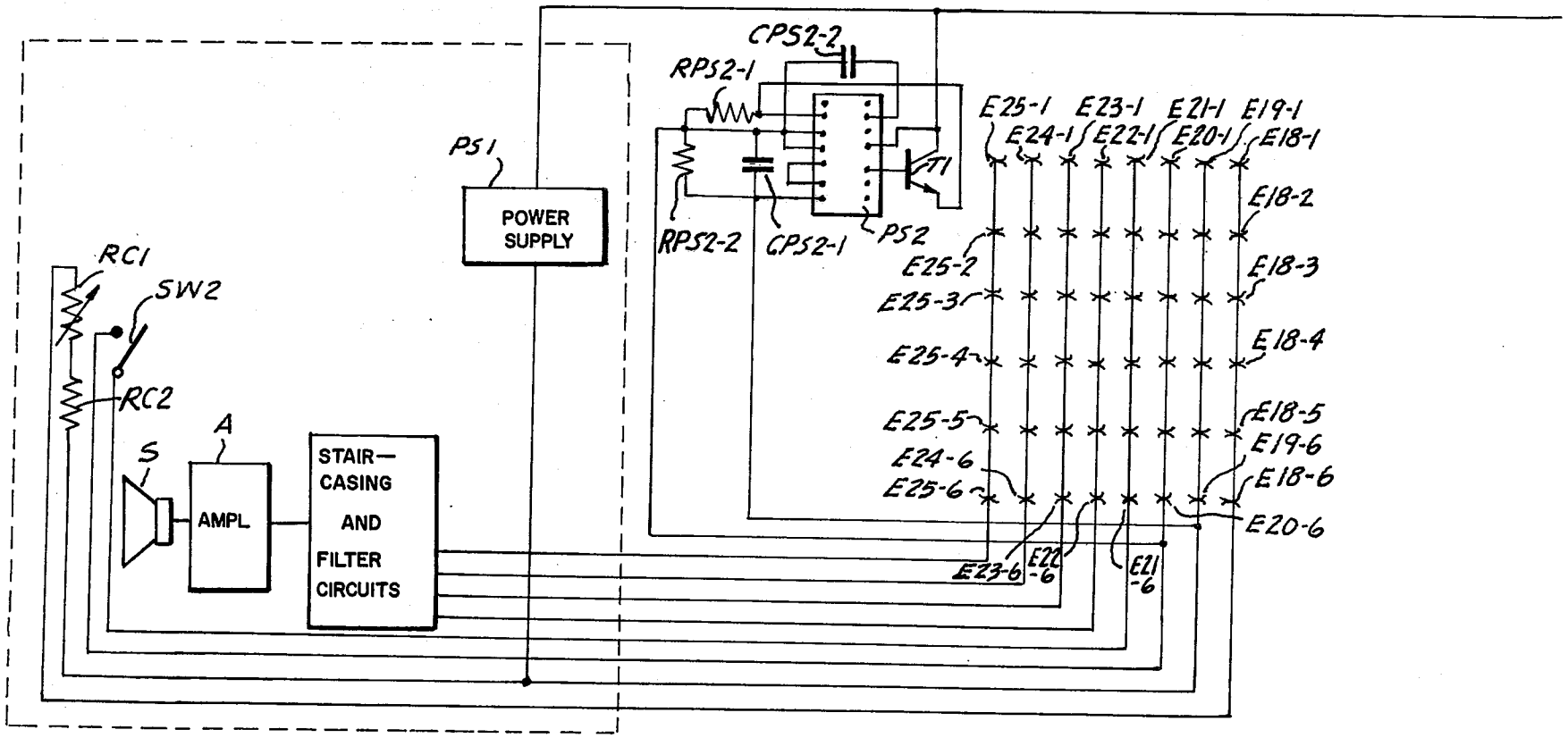
FIGS. 8C and 8D is a split schematic of the basic common circuit which receives the six plug-in modules one of which is illustrated in FIGS. 8A and 8B described above.
Figure 8D:
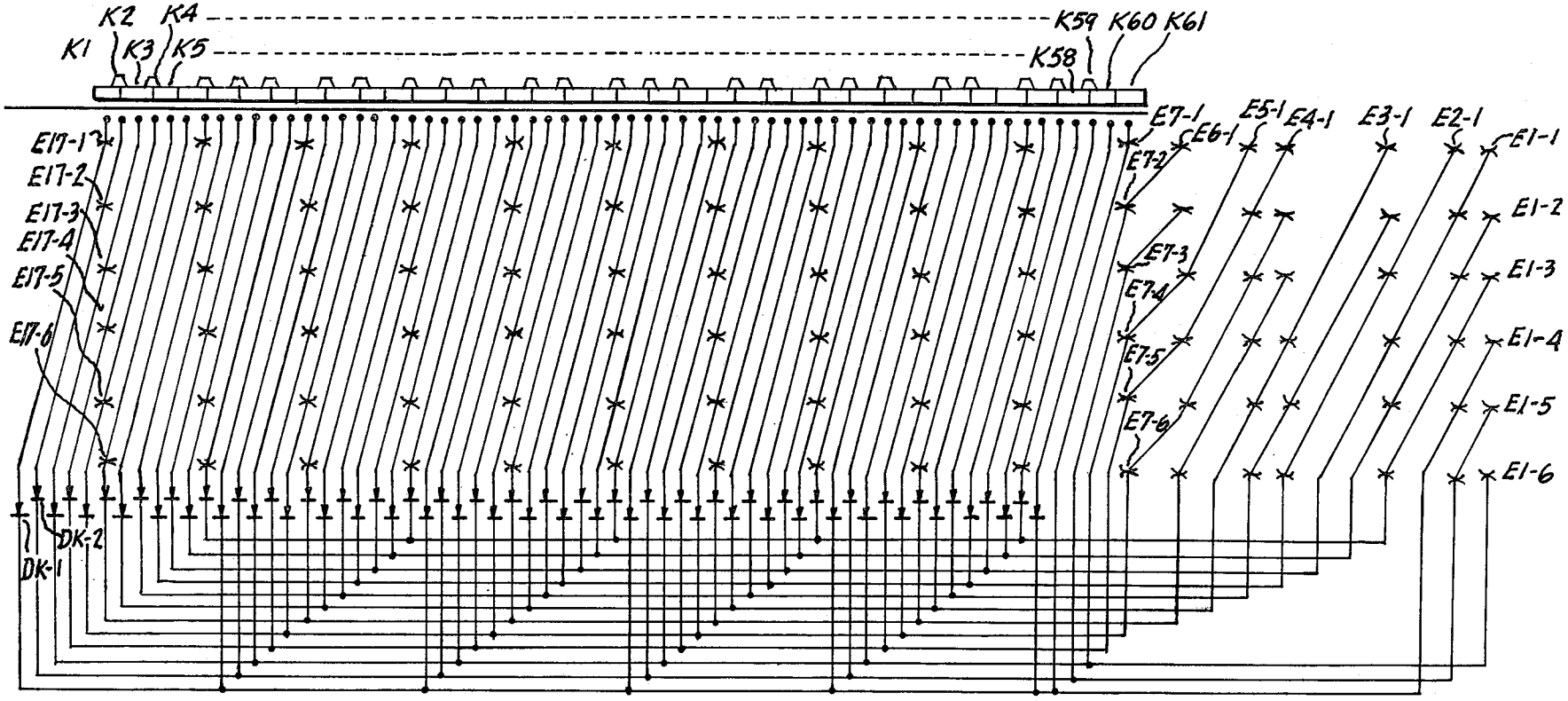

FIGS. 8A through 8D describe the entire invention in detail. FIGS. 8A and 8B illustrate the schematic of any one of the six plug-in modules. FIGS. 8C and 8D illustrate the rest of the circuit which includes connectors to receive the six plug-in modules.

While the invention has been particularly shown and described with reference to a preferred embodiment thereof, it will be understood by those skilled in the art that various changes in form and detail may be made therein without departing from the spirit and scope of the invention.

PARTS LIST

| ELEMENT NO. | DESCRIPTION | MANUFACTURER |
|---|---|---|
| RO1, RO7 | Resistor 10K carbon | |
| RO2, RO8 | Cermet 3006P Potentiometer 10K | Bourns Inc. |
| RO3, RO4, RO5, RO6 | Cermet 3352H Potentiometer 500K | " |
| RO9, RO10 | Resistor 100 ohm ½ W. | |
| RL1-RL12 | Resistor 100 K ohm ¼ W carbon | |
| RL13-RL24 | Resistor 150 K ohm ¼ W carbon | |
| RA1-RA11 | Resistor 270 ohm ¼ W carbon | |
| RB1-RB86 | Resistor 100K ohm ¼ W carbon | |
| RPS2-1 | Resistor 2.7 ohm ½ W carbon | |
| RPS2-2 | Resistor 10K ½ W carbon | |
| R-C1 | Variable Resistor 550R Cermet 25K | |
| DA1-DA22 | Diode 1N914A Silicon Computer Type | Texas Instruments |
| CO1, CO2 | Capacitor Ceramic .01 uf CW15C103K | Centralab |
| CO3, CO4 | Capacitor 10 uF TL1204 31D87 Electrolytic | Sprague |
| CO5, CO6 | Capacitor Ceramic 5HK S10 | Sprague |
| CA1-CA11 | Capacitor Electrolytic 35 uF TL 1208 31D91 | " |
| CPS2-1 | Capacitor Electrolytic 227G016CG 220 uF 16WV | " |
| CPS2-2 | Capacitor Ceramic 150 pF 5GAT15 | |
| FD1, FD2 | Integrated Circuit CD4024A | RCA |
| MO1, MO2 | Integrated Circuit CA 555 | " |
| BC1 | Integrated Circuit CD4001A | " |
| BC2 | Integrated Circuit CD4011A | " |
| PS2 | Integrated Circuit CA723 | " |
| T1 | Transistor 2N3055 | " |

I claim:

1. An apparatus for enabling a keyboard musical instrument to render intervals and chords in all inversions and transpositions with just intonation automatically, said apparatus comprising:

keyboard means for selecting certain notes;

a logic circuit means connected to said keyboard means;

tuning means connected to said logic circuit means, said tuning means having a first and a second input; and, octavely related tone producing elements connected to said tuning means, wherein activation of said first input of said tuning means adjusts at least one of said octavely related tone producing elements to sound lower in pitch by a single comma, and wherein activation of said second input of said tuning means adjusts at least one of said octavely related tone producing elements to sound lower in pitch by a double comma.

2. The apparatus of claim 1 wherein the single comma lowering of pitch caused by the activation of said first input is substantially 14 cents and werein the double comma lowering of pitch caused by the activation of said second input is substantially 31 cents.

3. A just intonation computer apparatus comprising:

at least one keyboard, each keyboard having a direct current keying means for sounding tone producing elements when activated by signals from said keyboard;

a logic circuit means connected to at least one keyboard whereby said logic circuit means is activated by the same signals from said keyboard used for activating said keying means;

tuning means connected to said logic circuit means;

octavely related tone producing elements connected to said tuning means, said tone producing elements being initially tuned to a scale of equal temperament, wherein said tuning means includes:

a first means for lowering the pitch of at least one of said octavely related tone producing elements by a single comma; and, a second means for lowering the pitch of at least one of said octavely related tone producing elements by a double comma.

4. The apparatus of claim 3 further comprising:

a diode branch circuit means connected between said keyboard means and said logic circuit means.

5. The apparatus of claim 3 wherein said apparatus includes means for performing the following functions which are representative of identical functions performed by the apparatus for all transpositions of the given chords where a single comma is designated by a note with the subscript 1 and a double comma is designated by a note with the subscript 2:

GB and/or BD=$GB_1$ or $B_1D$ or $GB_1D$

GBF and/or BDF=($GB_1F_2$ or $B_1DF_2$ and not $B_1D_1F$) or ($GB_1DF_2$ and not $GB_1D_1F$)

DF and/or FA=$D_1F$ or $FA_1$ or $D_1FA_1$ (GB and/or BD) and (DF and/or FA)=($B_1DF_2$ or $B_1DF_2A$ or $GB_1DF_2$ or $GB_1F_2A$ or $GB_1DF_2A$) and not ($B_1D_1F$ or $B_1D_1FA_1$ or $GB_1D_1F$ or $GB_1FA_1$ or $GB_1D_1FA_1$)

G#BDF=G#BDF and not ($G_1\#B_1D_1F_1$ or $A_2{}^{\flat}B_2D_2F_2$)

D♭FGB=D♭FGB and not ($D^{\flat}F_1GB_1$ or $D^{\flat}F_2GB_2$)

(GBF or BDF) and (DF#C or F#AC)=$B_1DF_2F_1\#C_2$ or $B_1DF_2F_1\#AC_2$ or $GB_1DF_2F_1\#C_2$ or $GB_1F_2F_1\#AC_2$ 6. The apparatus of claim 4 wherein said diode branch circuit means includes 12 diode branch circuits for interfacing each octavely related group of keys of the said keyboard means with each of 12 corresponding inputs of said logic circuit means.

7. The apparatus of claim 6 wherein said logic circuit means has 12 pairs of outputs, each of said pair of outputs being connected to a corresponding pair of inputs to said tuning means, and the output of each of said tuning means being connected to a corresponding group of octavely related tone producing elements.

8. The apparatus of claim 6 wherein each of the said 12 diode branch circuits comprises an array of diodes performing an inclusive OR function whereby the playing of any one or a plurality of keys within a group of octavely related keys of said keyboard means are equally effective to activate a corresponding single input of said logic circuit means.

9. The apparatus of claim 8 wherein said logic circuit means comprises 6 basic circuit means, each basic circuit means comprising:

two double input NAND gates, one input of each NAND gate being divided into two OR diode inputs and the other being a single input, the three inputs to each NAND gate being connected to certain inputs of said logic circuit means;

four double input NOR gates having the four outputs thereof connected to four outputs of said logic circuit means;

two inverter means each for reversing the logic state of a portion of the output from each of said NAND gates, wherein said NAND gates and said NOR gates in each basic circuit means are connected together reciprocally in such a manner that predetermined input signals to the logic circuit means and resulting output signals from said NAND gates serve as activating signals for predetermined NOR gates and as disable signals for other predetermined NOR gates.

10. The apparatus of claim 7 wherein each of said tuning means is connected to a master oscillator and is adapted to lower the frequency of said master oscillator by one comma when one input of said tuning means is activated or to lower the frequency of said master oscillator by two commas when the other input of said tuning means is activated, each master oscillator being connected to a chain of frequency dividers for generating an octavely related group of tones.

11. A just intonation apparatus comprising:

at least one 12 digital per octave keyboard;

a direct current keying means for each of said keyboards for sounding tone producing elements;

12 master oscillators and their associated frequency dividers for generating 12 octavely related groups of tones;

12 two input tuning means one for each of said 12 master oscillators, each tuning means being adjusted to lower the frequency of a corresponding master oscillator by substantially 14 cents when one input of the said tuning means is activated and adjusted or lower the frequency of the same master oscillator by substantially 31 cents when the other input of the same tuning means is activated;

a logic circuit means having 12 inputs corresponding to the 12 notes of the chromatic scale, said logic circuit having 12 pairs of outputs, each pair of outputs being connected to a corresponding pair of inputs of said tuning means; and, 12 diode branch circuit means for interfacing keying signals from each octavely related group of keys of said keyboard means with each of the corresponding 12 inputs of the said logic circuit means.

* * * * *

UNITED STATES PATENT OFFICE

CERTIFICATE OF CORRECTION

Patent No. 4,152,964 Dated May 8, 1979

Inventor(s) Harold M. Waage

It is certified that error appears in the above-identified patent and that said Letters Patent are hereby corrected as shown below:

Column 2, line 28, delete "ffect" insert instead --effect--.

Column 8, line 14, delete "4" insert instead --2--.

Column 9, line 36, delete "intonations" insert instead --intonation--.

Column 9, line 54, delete "flattened" insert instead --flatted--.

Column 11, line 14 delete "G#19B" insert instead --G#B--

Column 11, line 14 delete "$G_1^{\#} \cdot D_2^b \cdot \overline{A}_2 \cdot \overline{D}_1$" insert instead --$G_1^{\#} \cdot D_2 \cdot \overline{A}_2^b \cdot \overline{D}_1$--.

Column 15, line 3 delete "werein" insert instead --wherein--

In Figure 4 the terminal on upper left of MO1 should be connected to line at left.

Signed and Sealed this

Fourth Day of September 1979

[SEAL]

Attest:

Attesting Officer

LUTRELLE F. PARKER

Acting Commissioner of Patents and Trademarks